US010794233B2

(12) United States Patent
Stolk et al.

(10) Patent No.: US 10,794,233 B2
(45) Date of Patent: Oct. 6, 2020

(54) VALVE DRIVE DEVICE

(71) Applicant: Daimler AG, Stuttgart (DE)

(72) Inventors: Thomas Stolk, Kirchheim (DE); Alexander Von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 16/606,606

(22) PCT Filed: Apr. 11, 2018

(86) PCT No.: PCT/EP2018/059300
§ 371 (c)(1),
(2) Date: Oct. 18, 2019

(87) PCT Pub. No.: WO2018/192822
PCT Pub. Date: Oct. 25, 2018

(65) Prior Publication Data

US 2020/0182096 A1 Jun. 11, 2020

(30) Foreign Application Priority Data

Apr. 20, 2017 (DE) ..... 10 2017 003 790

(51) Int. Cl.
*F01L 1/34* (2006.01)
*F01L 1/047* (2006.01)
*F01L 13/00* (2006.01)

(52) U.S. Cl.
CPC ..... *F01L 1/047* (2013.01); *F01L 13/0005* (2013.01)

(58) Field of Classification Search
CPC ..... F01L 1/047; F01L 13/005
See application file for complete search history.

(56) References Cited

U.S. PATENT DOCUMENTS 8,714,125 B2 * 5/2014 Kamichika ..... F01L 1/047 123/90.16

FOREIGN PATENT DOCUMENTS

| | | |
|---|---|---|
| DE | 102 41 920 A1 | 3/2004 |
| DE | 10 2012 016 356 A1 | 2/2014 |
| DE | 10 2012 217 297 A1 | 3/2014 |
| DE | 10 2015 012 044 A1 | 3/2017 |
| DE | 10 2015 014 175 A1 | 5/2017 |

OTHER PUBLICATIONS

PCT/EP2018/059300, International Search Report dated Jul. 12, 2018 (Two (2) pages).
German Search Report issued in German counterpart application No. 10 2017 003 790.6 dated Mar. 12, 2018, with Statement of Relevancy (Nine (9) pages).

* cited by examiner

*Primary Examiner* — Zelalem Eshete
(74) *Attorney, Agent, or Firm* — Crowell & Moring LLP

(57) ABSTRACT

A valve drive device, in particular for an internal combustion engine, includes a support element fixed to a housing and at least one axially shiftable cam unit allocated to a valve. The cam unit has at least three cam tracks. At least one switching unit which is a displacement body is provided to displace at least one part of the cam unit in the direction of a first actuation direction for axial shifting. The displacement body displaces at least one part of the cam unit in the direction of a second actuation direction opposing the first actuation direction.

8 Claims, 6 Drawing Sheets

VALVE DRIVE DEVICE

BACKGROUND AND SUMMARY OF THE INVENTION

The invention relates to a valve drive device and a method for operating a valve drive device.

A valve drive device, in particular for an internal combustion engine, having a support element fixed to a housing and having at least one axially shiftable cam unit allocated to a valve and having at least one switching unit for axially shifting at least one part of the cam unit, which comprises at least one displacement body, which is provided for displacing at least one part of the cam unit for axial shifting is already known from DE 10 2015 014 175.

In particular, the object of the invention is to provide a valve drive device having a switchover of a cam unit by means of a displacer principle, the valve drive device advantageously being compact and cost-effective.

The invention is based on a valve drive device, in particular for an internal combustion engine, having a support element fixed to a housing and having at least one axially shiftable cam unit allocated to a valve, the cam unit having at least three cam tracks, and having at least one switching unit for axially shifting at least one part of the cam unit, which comprises a displacement body, which is provided for displacing at least one part of the cam unit in the direction of a first actuation direction for axial shifting.

It is proposed that the displacement body be provided to displace at least one part of the cam unit in the direction of a second actuation direction opposite the first actuation device. As a result, a valve drive device that can be switched by a displacement principle can be particularly advantageously provided, the valve drive device advantageously being compact and cost-effective. In particular, in doing so, an advantageously low axial construction length of the valve drive device, in particular of the switching unit, can be made possible. In particular, a construction volume between the valves can be kept low. This leads, in particular, to a low minimum valve spacing, whereby application in small, in particular economical, engines is possible. Furthermore, a simple construction can thus be obtained. In doing so, particularly low production and repair costs emerge.

Here, "support element fixed to the housing" is to be understood, in particular, as an element, such as mounting points, for example, for a cam shaft that is fixedly connected to a housing of the valve drive device. It is also conceivable, in principle, that the support element fixed to the housing is formed as a part of the housing of the valve drive device. Here, a "cam unit" is to be understood as a unit made of at least one cam element, wherein a cam element is arranged rotationally fixedly and preferably axially shiftably on a cam shaft and, to actuate a valve, is provided to supply the corresponding valve directly or indirectly with at least one valve stroke. To do so, a cam element has at least one cam track, preferably several cam tracks. Preferably, a cam unit for actuating a valve has a cam element having several, preferably in particular three, different cam tracks. Particularly advantageously, a cam unit for actuating two valves of a cylinder has a cam element having several respective cam tracks arranged in groups for actuating each of the valves. In principle, it is also conceivable that a cam unit for actuating a valve has several, preferably at least three, cam elements, which each have a cam track for actuating the valve. Here, a "cam shaft" shall be understood, in particular, as a shaft, which is provided for actuating several valves of the internal combustion engine and has at least one respective cam track for actuating a valve. Here, it is conceivable both that the cam shaft is formed as an inlet cam shaft and is provided to actuate inlet valves and that the cam shaft is formed as an outlet cam shaft and is provided to actuate outlet valves. In principle, it would also be conceivable that the cam shaft is provided for actuating inlet valves and for actuating outlet valves. A "cam track" shall be understood, in particular, to mean a region running on a periphery of the cam shaft, preferably on a periphery of a cam element, the region forming a valve actuation curve for valve actuation and/or defining the valve actuation. A "switching unit" shall be understood, in particular, to mean a unit which is provided to shift at least one part of a cam unit, preferably the entire cam unit, axially on the cam shaft, in order to bring different cam tracks of the cam element into engagement with the corresponding valve. Here, the switching unit preferably has an actuator and a coupling element connected to the actuator and the cam element to be adjusted. Here, the coupling element is preferably formed as a displacement body. An "actuator" shall be understood, in particular, as a mechatronic component which is provided to implement a movement of electric and/or electronic signals, in particular a rotational and/or linear movement. Here, an actuator is preferably formed as a spindle drive, a pneumatic piston, a hydraulic piston or as a different actuator also seeming significant to the person skilled in the art. As a result, the switching unit is provided, in particular, to axially shift the cam element. Here, the switching unit is controlled for shifting the cam element preferably by a control and/or regulating unit. "Provided" is, in particular, to be understood as specially designed, equipped and/or arranged. "Control and/or regulation unit" is, in particular, to be understood as a unit with at least one electronic control device. An electronic "control device" is, in particular, to be understood as a unit with a processor unit and with a storage unit, as well as with an operating program stored in the storage unit. The control and/or regulating unit can fundamentally have several control devices connected one beneath the other, which are preferably provided to communicate with one another via a bus system such as a CAN bus system. Depending on a further embodiment, the control and/or regulation unit can also additionally have hydraulic and/or pneumatic components, such as valves, in particular. Here, a "displacement body" is to be understood, in particular, as a body which displaces another element in a switching direction by means of a movement in an actuation direction, wherein the switching direction is here preferably different from the actuation direction. The switching direction is particularly preferably orthogonal to the actuation direction. Preferably, the displacement body comprises a displacement surface angled in relation to the actuation direction and, in particular, also to the switching direction, by means of which a movement of the displacement body is deflected into the switching direction, in particular by at least approximately 90° into a movement of the other element into the actuation direction.

Furthermore, it is proposed that the cam unit be allocated to at least two valves. The cam unit preferably respectively has at least three cam tracks for each valve. Preferably, an activation and/or deactivation of one of the cam tracks of the at least two valves takes place simultaneously. As a result, an advantageously compact construction, in particular, can be achieved. Furthermore, as a result, an advantageously small spacing between the valves can be made possible. Here, an "activation of a cam track" can be understood, in particular, as a switching process, which brings the corresponding cam track into engagement with the valve to be actuated. Here, a "deactivation of a cam track" shall be understood, in particular, to mean a switching process, which moves the corresponding cam track out of an engagement with the valve.

Furthermore, it is proposed that the displacement body have at least two different contact surfaces. Preferably, the contact surfaces have different angles and are provided for a contacting of different regions, in particular the cam unit. As a result, various actuation functions, in particular, can be achieved with the displacement body. Various actuation directions, in particular, can be achieved. Each contact surface is preferably allocated to an actuation direction. A "contact surface" in this context shall be understood, in particular, as a surface of the displacement body, which is provided in at least one operating state for a direct contacting of the cam unit. Preferably, it shall also be understood to be a surface of the displacement body, which is provided at least partially during a displacement process for a contacting of the cam unit. A displacement force is particularly preferably transferred to the cam unit at least partially during a displacement process by means of the contact surface.

Furthermore, it is also proposed that the at least two contact surfaces of the displacement body are angled in relation to each other. As a result, various actuation functions, in particular, can be achieved with the displacement body. Various actuation directions, in particular, can be achieved.

It is furthermore proposed that the valve drive device have at least one shifting element which is provided to adjust the switching unit in relation to the support element. Preferably, the shifting element is provided to adjust the switching unit axially in relation to the cam unit. As a result, the switching unit can advantageously be used to switch the at least three cam tracks. Here, a "shifting element" shall be understood, in particular, as an element which has at least one actuator for a shifting of a different element, such as the switching unit, in particular, via which actuator the element can be shifted between at least two switching positions. Here, the actuator of the shifting element is formed as an actuator that seems significant to the person skilled in the art, in particular as a spindle drive with an electromotor. In principle, it is also conceivable that the actuator is formed as a pneumatic, hydraulic or electromechanical actuator.

In addition, it is proposed that the at least one shifting element have at least three shifting positions. The shifting element preferably has exactly three shifting positions. As a result, an advantageous switching variability of the switching unit, in particular, can be provided. Furthermore, the switching unit can thus advantageously be used for switching the at least three cam tracks.

Furthermore, it is proposed that a width of the displacement body be substantially double the width of a cam track. As a result, an actuation of the cam unit, in particular, can be obtained advantageously compactly in two actuation directions. The "width" shall be understood in this context, in particular, as the extension of an element in parallel to an axis of rotation of the cam unit.

Furthermore, it is proposed that the cam unit have at least two displacement contours formed to correspond to the displacement body. Preferably, the displacement contours are provided for the displacement contour to come into frictionally engaged contact for adjusting the cam unit. Preferably, the displacement contour forms an edge on the cam unit running in the peripheral direction, which is at least partially facing towards the displacement body. As a result, an advantageously compact construction, in particular, can be achieved.

Furthermore, it is proposed that the at least two displacement contours be formed as edges of a groove in the cam unit. Preferably, the groove is formed by a groove running in the peripheral direction of the cam unit. As a result, an advantageously compact construction, in particular, can be achieved.

Further advantages arise from the following description of the figures. An exemplary embodiment of the invention is depicted in the figures. The figures, the description of the figures and the claims contain numerous features in combination. The person skilled in the art will also necessarily consider the features individually and will integrate them into further worthwhile combinations.

DETAILED DESCRIPTION OF THE DRAWINGS

Figure 1:
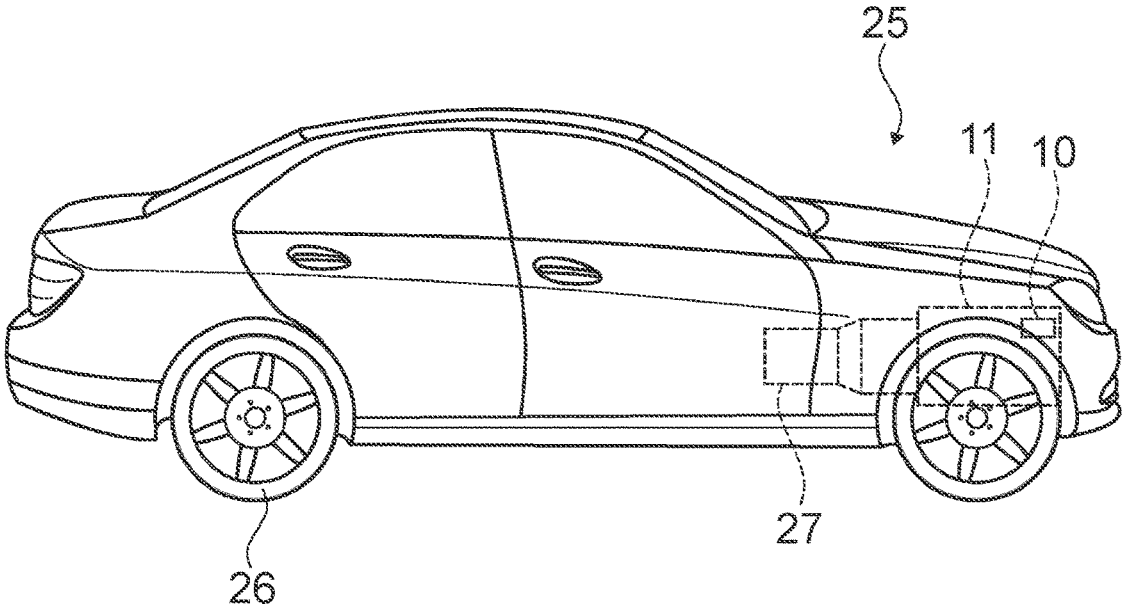
FIG. 1 is a schematic depiction of a motor vehicle having a drive unit, which comprises a valve drive device according to the invention, and having a multi-stage transmission in a schematic depiction.

FIG. 1 schematically shows a motor vehicle 25. The motor vehicle 25 comprises a drive train, by means of which drive wheels 26 of the motor vehicle 25 are driven, which is not visible in further detail. The drive train comprises an internal combustion engine 11. The internal combustion engine 11 is formed from a combustion motor. Furthermore, the motor vehicle 25 has a multi-stage transmission 27. The internal combustion engine 11 has a driven crankshaft which is connected to a transmission input element of the multi-stage transmission 27. The multi-stage transmission 27 is formed from a motor vehicle transmission. The multi-stage transmission 27 forms a part of the drive train of the motor vehicle 25. The internal combustion engine 11 comprises at least one valve drive device 10. Preferably, the internal combustion engine 11 comprises several valve drive devices 10. The internal combustion engine 11 is formed as a motor vehicle internal combustion engine, which is provided to convert chemical energy into kinetic energy which serves, in particular, to propel a motor vehicle 25. The internal combustion engine 11 here has several cylinders each having several valves 28, 29. The internal combustion engine 11 has two valves 28, 29 formed as inlet valves and two valves formed as outlet valves. In principle, it is also conceivable that the internal combustion engine 11 has a different number of valves 28, 29. Here, the valves 28, 29 are schematically depicted by their actuation plane in FIGS. 2 to 10.

FIGS. 2 to 11 show a schematic depiction of the valve drive device 10 in various switching positions. The valve drive device 10 is part of the internal combustion engine 11. The valve drive device 10 is provided for actuating the valves 28, 29 of the internal combustion engine 11. The valve drive device 10 has a cam shaft 30 for actuating the valves 28, 29. In FIGS. 2 to 11, only one part of the cam shaft 30, which is allocated to a cylinder, is depicted. The cam shaft 30 is mounted in a support element 12 fixed to the housing. The valve drive device 10 has the support element 12 fixed to the housing. Here, it is conceivable that the support element 12 is formed as a housing of the valve drive device 10. Furthermore, the valve drive device 10 has a further cam shaft not depicted in more detail. The depicted cam shaft 30 is here exemplarily formed as an inlet cam shaft and the cam shaft not depicted in more detail as an outlet cam shaft. Below, only the part of the cam shaft 30 shown in FIGS. 2 to 11 is described in more detail. The description can also be transferred to the part of the cam shaft 30 not depicted in more detail and the cam shaft that is not depicted in more detail.

The cam shaft 30 is rotatably mounted in a valve drive housing that is not depicted in more detail. Here, the cam shaft 30 is mounted rotatably around an axis of rotation 31. Here, the axis of rotation 31 of the cam shaft 30 is aligned substantially in parallel to an axis of rotation of a crank shaft of the internal combustion engine 11. The cam shaft 30 is driven by the crank shaft via a coupling not depicted in more detail. The valve drive device 10 comprises one cam unit 13 per cylinder. The valve drive device 10 has a cam unit 13 that is axially shiftable and allocated to at least one valve 28, 29. The valve unit 13 is allocated to two valves 28, 29. In principle, it is also conceivable that the valve drive device 10 has a different number of cam units 13 per cylinder. The cam unit 13 is formed from a cam element. In principle, it is also conceivable that the cam unit 13 is formed from several cam elements.

The cam unit 13 is arranged axially shiftably on the cam shaft 30. Here, the cam unit 13 is rotationally fixedly coupled to the cam shaft 30. Here, the cam unit 13 is connected to the cam shaft 30, in particular via a toothing that is not depicted in more detail. The cam unit 13 is provided for actuating the valves 28. 29. The cam unit 13 has at least three cam tracks 14, 15, 16, 14', 15', 16'. The cam unit 13 has three cam tracks 14, 15, 16, 14', 15', 16' per valve 28, 29. In principle, it is also conceivable that the cam unit 13 has only two or more than the three cam tracks 14, 15, 16, 14', 15', 16' per valve 28. 29. The cam tracks 14, 15, 16, 14', 15', 16' each have different contours and thus actuate the respective valve 28, 29 with correspondingly different valve strokes. In a first switching position of the cam unit 13, the first cam tracks 14, 14' actuate the respective valve 28, 29. In a first switching position of the cam unit 13, the first cam tracks 14, 14' actuate the respective valve 28, 29 with an average stroke. In a second switching position of the cam unit 13, the second cam tracks 15, 15' actuate the respective valve 28, 29. In a second switching position of the cam unit 13, the second cam tracks 15, 15' actuate the respective valve 28, 29 with a large stroke. In a third switching position of the cam unit 13, the third cam tracks 16, 16' actuate the respective valve 28, 29. In a third switching position of the cam unit 13, the third cam tracks 16, 16' actuate the respective valve 28, 29 with a low stroke. The actuation of a valve 28, 29 by a cam track 14, 15, 16, 14', 15', 16' takes place in a manner known to the person skilled in the art.

Furthermore, the valve drive device 10 has a switching unit 17. The switching unit 17 is provided for axially shifting at least one part of the cam unit 13. The switching unit 17 is provided for axially shifting the cam unit 13 on the cam shaft 30. The valve drive device 10 has the switching unit 17 for adjusting the cam unit 13 on the cam shaft 30 between the three switching positions. The switching unit 17 is provided to axially shift the cam unit 13 on the cam shaft 30 in order to bring the different cam tracks 14, 15, 16, 14', 15', 16' into engagement with the respective valve 28, 29. Here, the switching unit 17 is provided to adjust the cam unit 13 by means of a displacer principle between the switching positions. The switching unit 17 is provided to adjust the cam unit 13 by a displacement, in particular orthogonally to an actuation direction 32 of the switching unit 17.

The switching unit 17 comprises a displacement body 18. The displacement body 18 is provided to displace at least one part of the cam unit 13 in the direction of a first actuation direction 32 for axial shifting. The displacement body 18 is provided to displace the cam unit 13 in the direction of the first actuation direction 32 for axial shifting. Furthermore, the displacement body 18 is provided to displace the cam unit 13 in the direction of a second actuation direction 33 opposite the first actuation direction 32. The actuation directions 32, 33 each extend in parallel to the axis of rotation 31 of the cam shaft 30. For the axial shifting of the cam unit 13, the displacement body 18 is provided to be operatively introduced between the support element 12 and the cam unit 13. The displacement body 18 has at least one width b1, which corresponds to a shifting path of the cam unit 13 between two switching positions of immediately adjacent cam tracks 14, 15, 16, 14', 15', 16'. The width of the displacement body 18 corresponds to at least one width b2 of a cam track 14, 15, 16, 14', 15', 16'. A width b1 of the displacement body 18 is substantially double the width b2 of a cam track 14, 15, 16, 14', 15', 16'.

The cam unit 13 forms at least one displacement contour 22, 23 which is formed to corresponding to the displacement body 18. The cam unit 13 has two displacement contours 22, 23 formed to correspond to the displacement body 18. The displacement contours 22, 23 are provided so that the displacement body 19 comes into frictional contact for adjusting the cam unit 13. The displacement contours 22, 23 are here each allocated to one of the actuation directions 32, 33. The first displacement contour 22 is contacted by the displacement body 18 for displacing the cam unit 13 in the first actuation direction 32. The second displacement contour 23 is contacted by the displacement body 18 for displacing the cam unit 13 in the second actuation direction 33. The two displacement contours 22, 23 are each formed as an edge of a groove 24 in the cam unit 13. Here, the peripheral groove 24 has a width which approximately corresponds to the width b1 of the displacement body 18.

Furthermore, the displacement body 18 has at least two different contact surfaces 19, 20. The displacement body 18 has two angled contact surfaces 19, 20. The two contact surfaces 19, 20 of the displacement body 18 are angled in relation to each other. The two contact surfaces 19, 20 are each allocated to a displacement contour 22, 23. The first contact surface 19 is provided for a contacting of the first displacement contour 22. The second contact surface 20 is provided for a contacting of the second displacement contour 23. In the event of an operative insertion of the displacement body 18, firstly one of the angled contact surfaces 19, 20 of the displacement body 18 touches the cam unit 13. Here, the first contact surface 19 is used for a displacement of the cam unit 13 in the first actuation direction 32, while the second contact surface 20 is used for a displacement of the cam unit 13 in the second actuation direction 33. The displacement body 18 has a wedge shape, which forms the angled contact surfaces 19, 20. In the event of the displacement body 18 being inserted in the radial direction in relation to the axis of rotation 31 onto the cam unit 13, one of the contact surfaces 19, 20 laterally engages on the respectively corresponding displacement contour 22, 23 of the cam unit 13. In the event of another insertion of the displacement body 18, the cam unit 13 slides on the respective contact surface 19, 20 depending on the actuation direction 32, 33 and is shifted by the displacement body 18 in the respective actuation direction 32, 33. In a switching process, the displacement body 18 is pressed against the respectively corresponding displacement contour 22, 23 of the cam unit with one of its angled contact surfaces 19, 20 depending on the actuation direction 32, 33 and it thus displaces the cam unit 13 in a corresponding actuation direction 32, 33.

In an operating state, in which the cam unit 13 is not axially shifted between its switching positions, the displacement contour 18 forms an axial mount for the cam unit 13. With the formation of the axial mount for the cam unit 13, the displacement body 18 respectively forms axial stops for the cam unit 13, by the displacement body 18 being arranged in the groove 24 of the cam unit 13. In principle, it is also conceivable that the displacement body 18 and the corresponding displacement contours 22, 23 are formed in a different manner seeming significant to the person skilled in the art. Here, it is conceivable, for example, that the displacement contours 22, 23 are formed as ribs with an angled contact surface. Here, the displacement body 18 could be formed correspondingly equivalently.

The switching unit 17 comprises an actuator 34. The actuator 34 is provided for actuating the displacement body 18. Furthermore, the switching unit 17 comprises a housing 35. Here, the actuator 34 of the switching unit 17 is arranged inside the housing 35. The displacement body 18 is shiftably mounted in the housing 35. Here, the displacement body 18 is linearly shiftable in a radial direction in relation to the axis of rotation 31. In a state in which the displacement body 19 is operatively introduced into the cam unit 13, the displacement body 19 is in an extended state. In a first switching position of the actuator 34, the displacement body 18 engages in the grove 24 of the cam unit 13. In a second switching position, the displacement body 18 is spaced apart from the cam unit 13.

Figure 10:
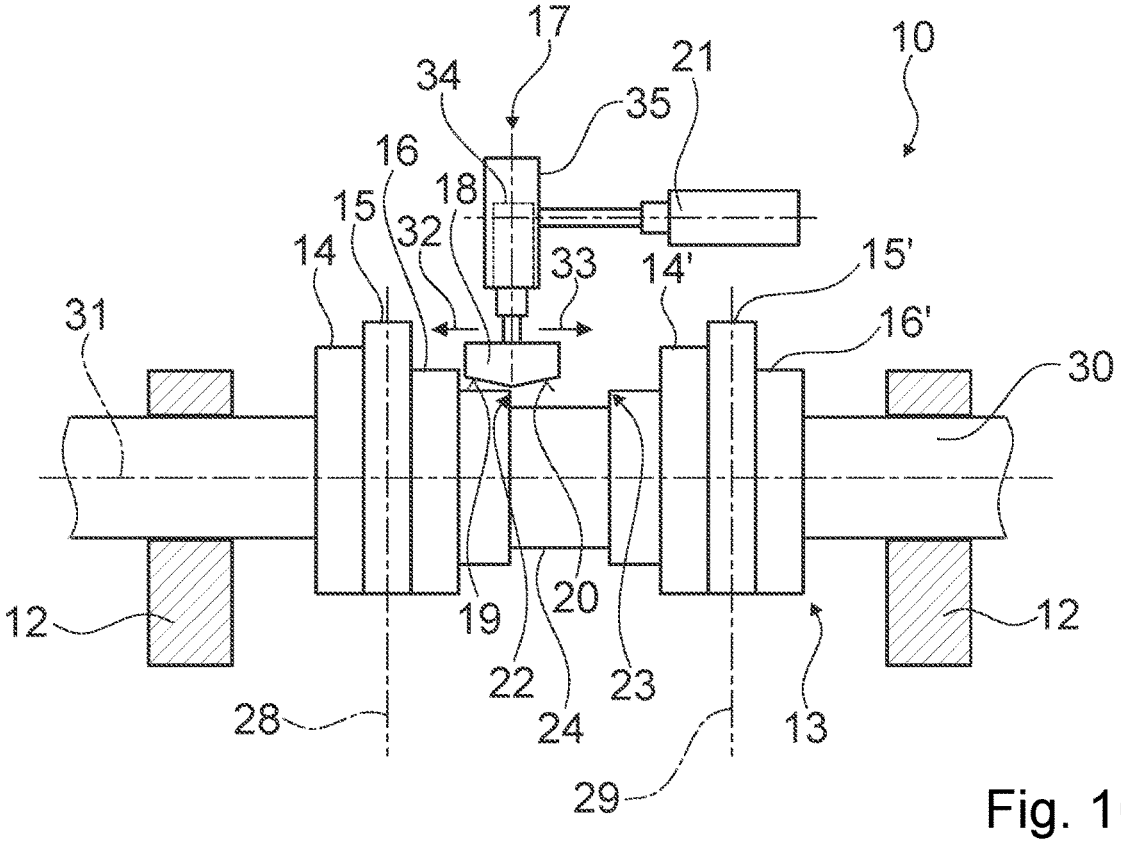
FIG. 10 is a schematic depiction of the valve drive device according to the invention having a cam unit in a further intermediary position from the second switching position into the third switching position.
Figure 11:
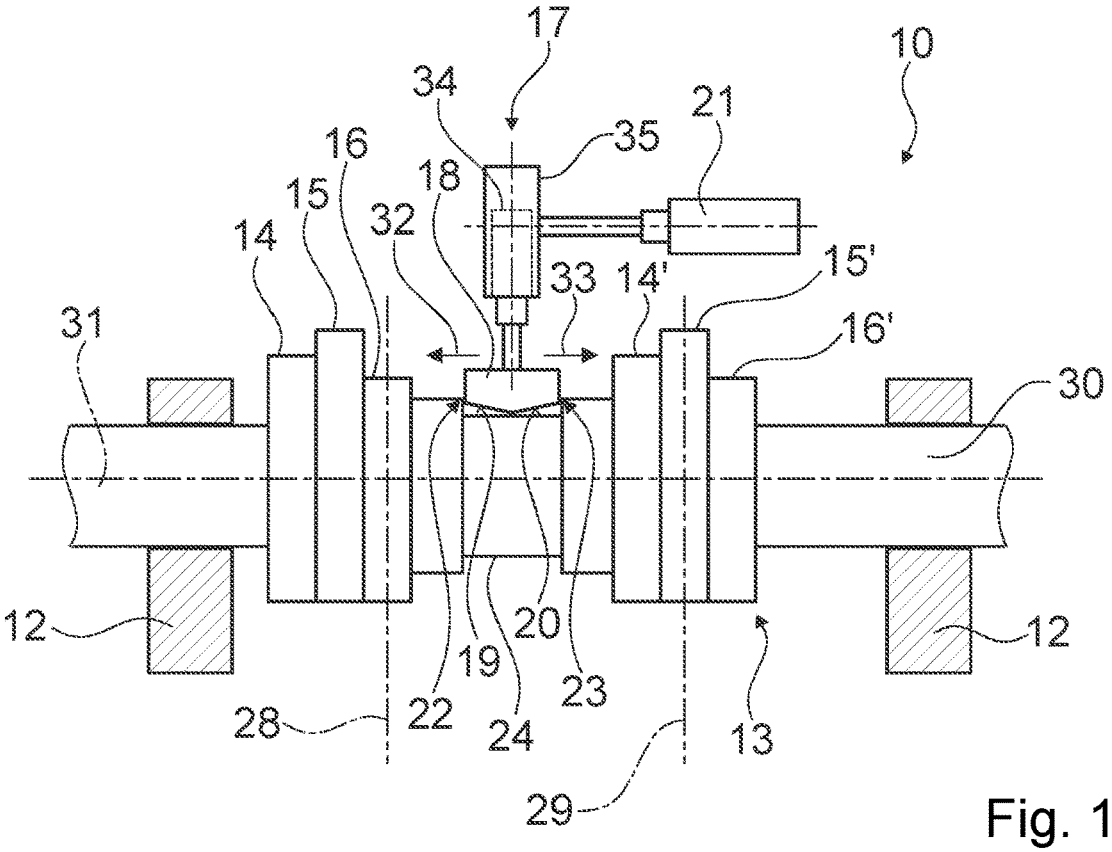
FIG. 11 is a schematic depiction of the valve drive device according to the invention having a cam unit in a third switching position.

Furthermore, the valve drive device 10 has a shifting element 21. The shifting element 21 is provided to adjust the switching unit 17 axially in relation to the support element 12. The shifting element 21 is provided to adjust the entire switching unit 17 in parallel to the axis of rotation 31 of the cam shaft 30. To that end, the switching unit 17 is mounted axially shiftably in the housing in the valve drive device 10. Here, the switching unit 17 is mounted in the housing of the valve drive device 10 via a mounting unit not depicted in more detail. Here, the switching unit 17 is mounted shiftably between at least two switching positions. The shifting element 21 has three shifting positions. The switching unit 17 is thus mounted shiftably between three switching positions. In FIGS. 2, 3, 7, 8, and 9, a first switching position of the switching unit 17 is depicted. In FIGS. 4, 5 and 6, a second switching position of the switching unit 17 is depicted. In FIGS. 10 and 11, a third switching position of the switching unit 17 is depicted. The switching unit 17 is provided to be axially shifted for switching to an outer cam track 14, 14', 16, 16' of the three cam tracks 14, 15, 16, 14', 15', 16'. The shifting element 21 is formed as an actuator which comprises an axially extendable actuating lever. Here, the actuator is formed as an electronically controllable spindle gear. In principle, it is also conceivable that the actuator is formed as a pneumatic or hydraulic actuator.

Figure 2:
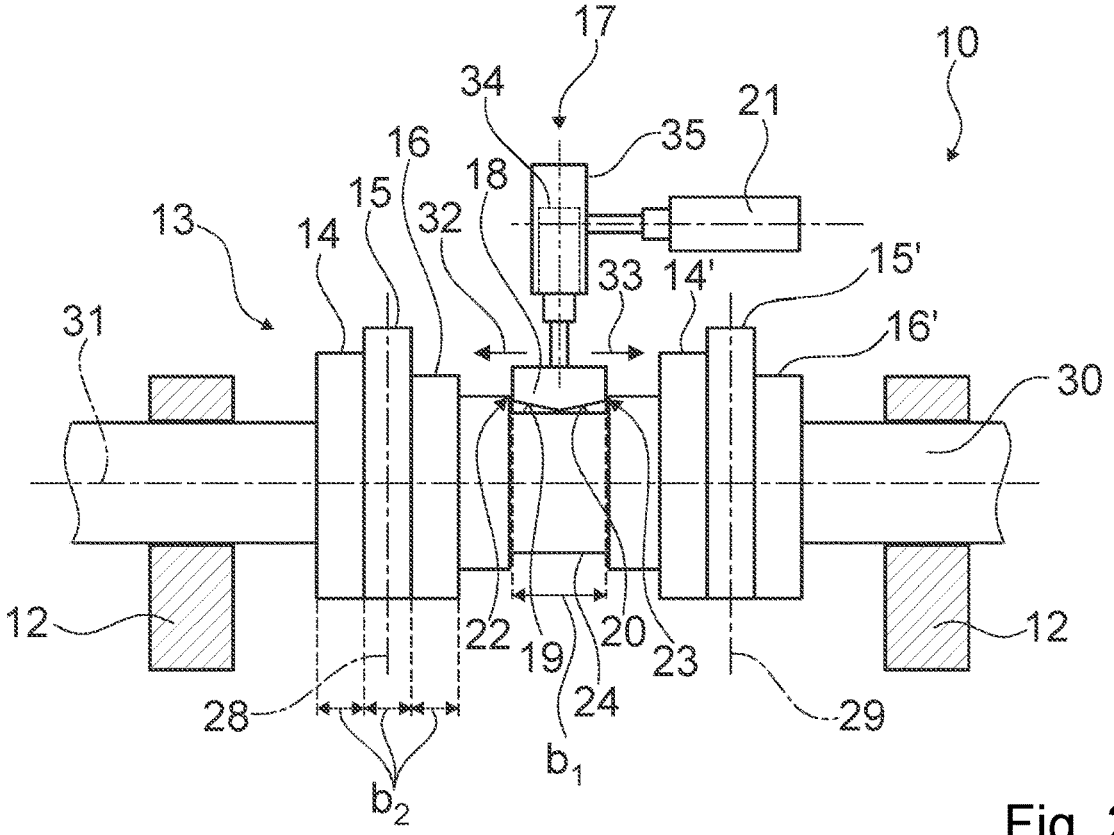
FIG. 2 is a schematic depiction of the valve drive device according to the invention having a cam unit in a second switching position.
Figure 3:
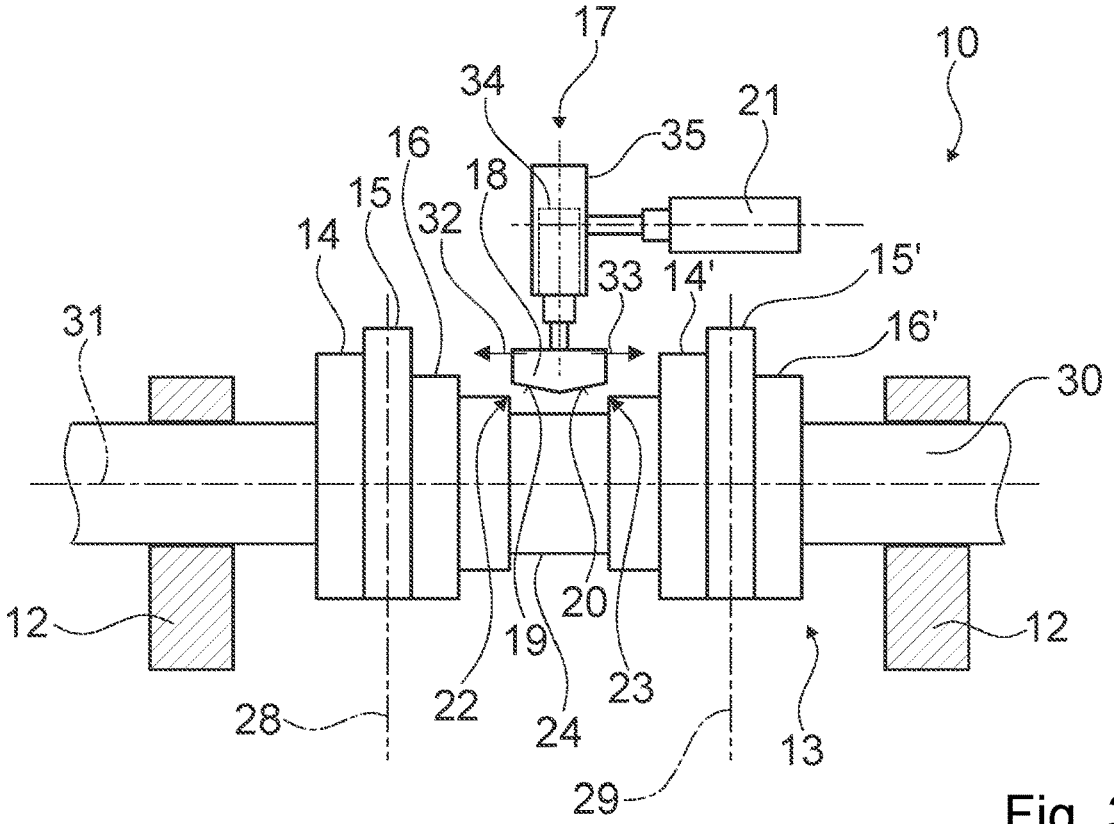
FIG. 3 is a schematic depiction of the valve drive device according to the invention having the cam unit in an intermediary position from the second switching position into the first switching position.
Figure 4:
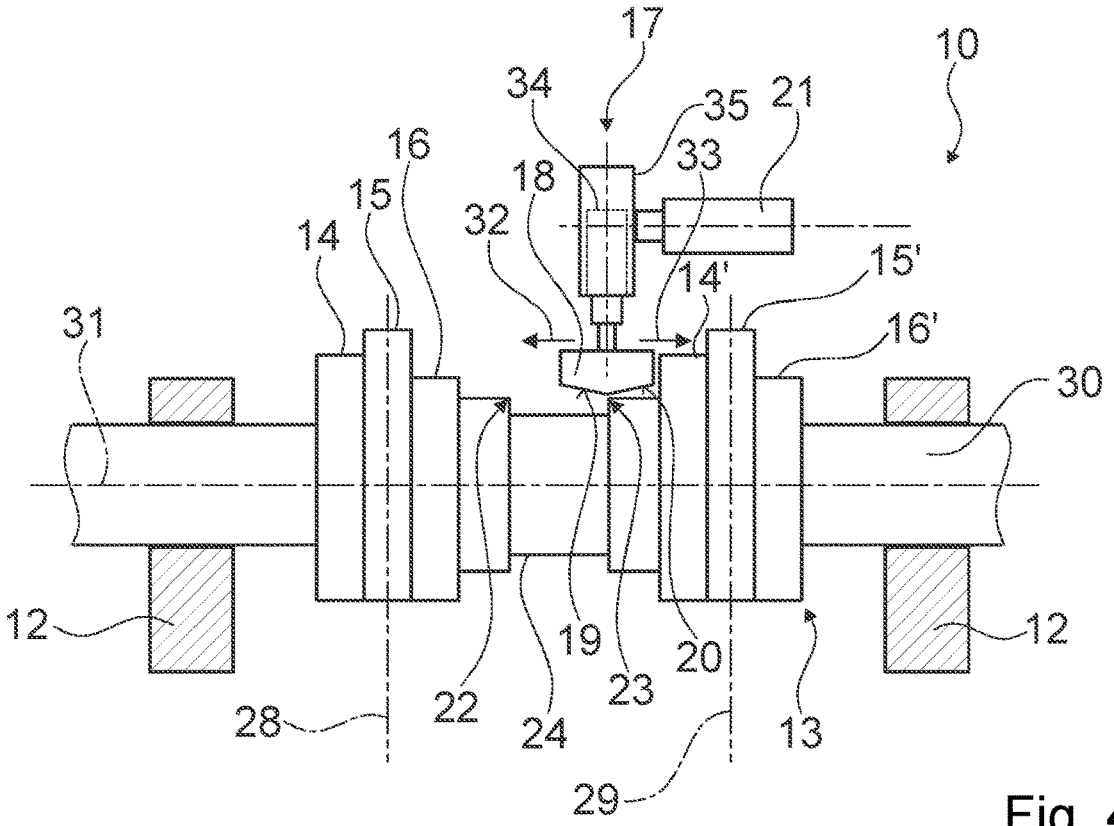
FIG. 4 is a schematic depiction of the valve drive device according to the invention having the cam unit in a further intermediary position from the second switching position into the first switching position.
Figure 5:
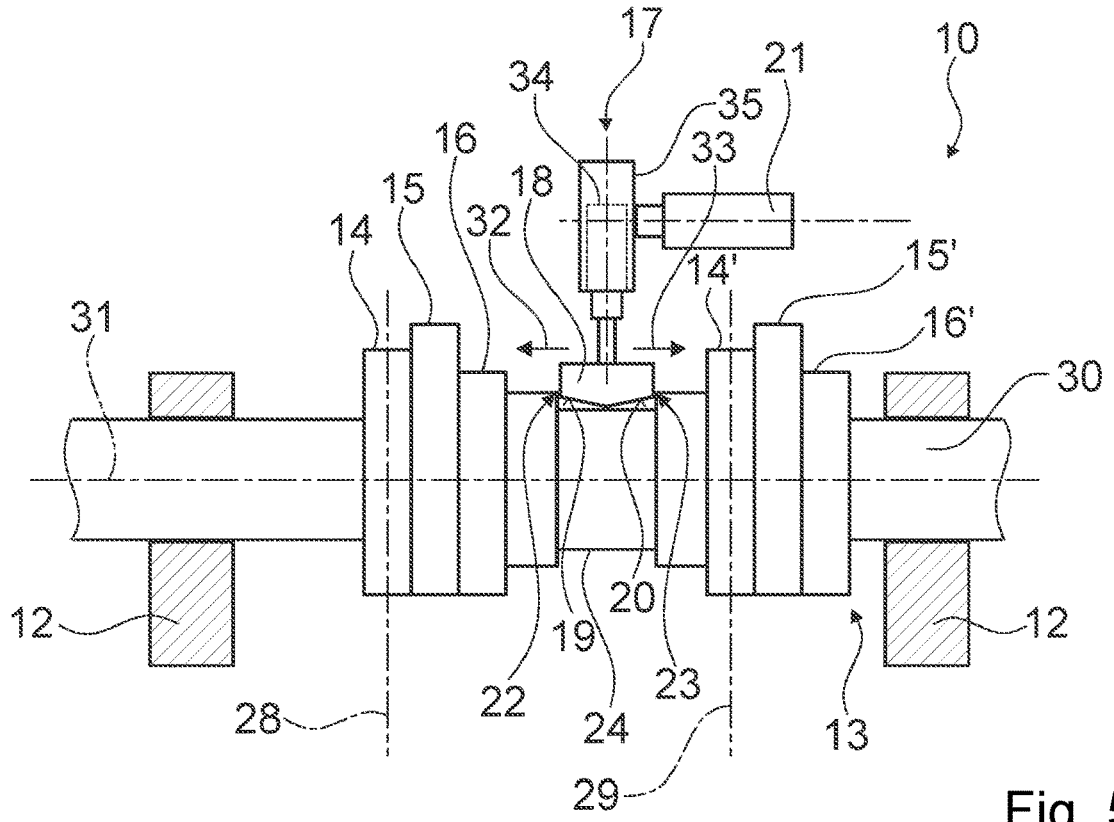
FIG. 5 is a schematic depiction of the valve drive device according to the invention having the cam unit in a first switching position.
Figure 6:
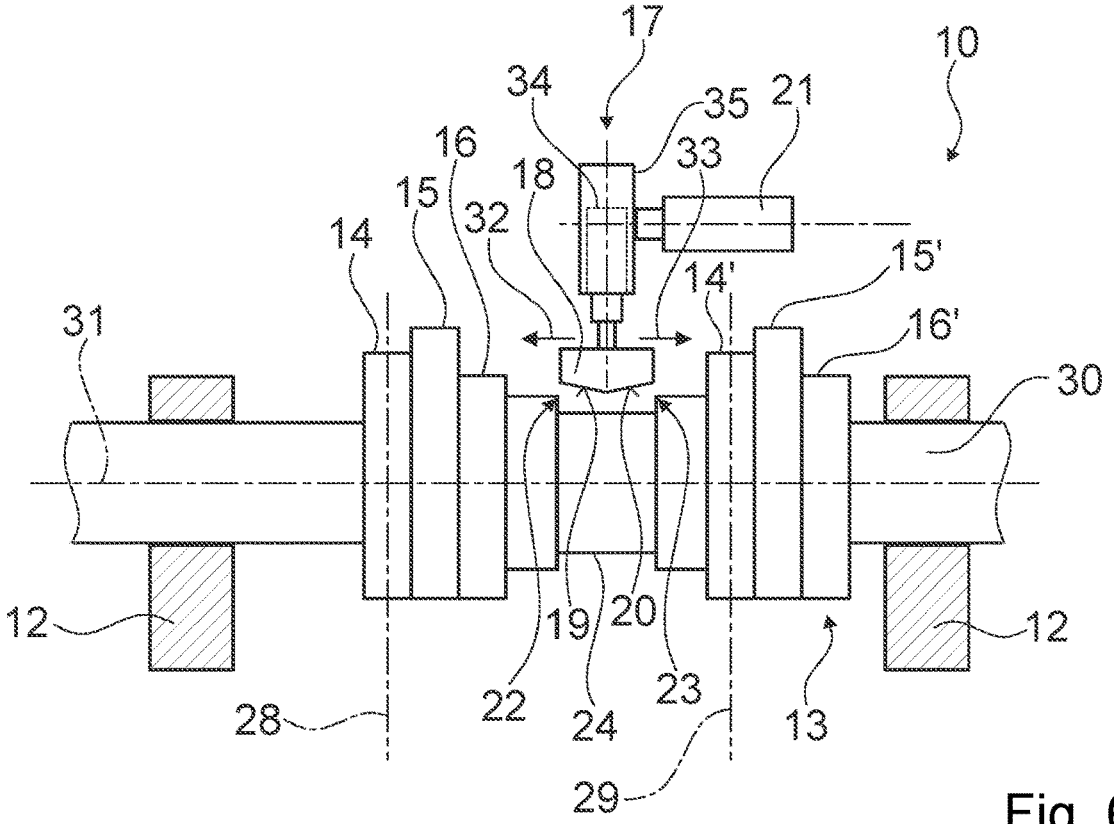
FIG. 6 is a schematic depiction of the valve drive device according to the invention having the cam unit in an intermediary position from the first switching position into the second switching position.
Figure 7:
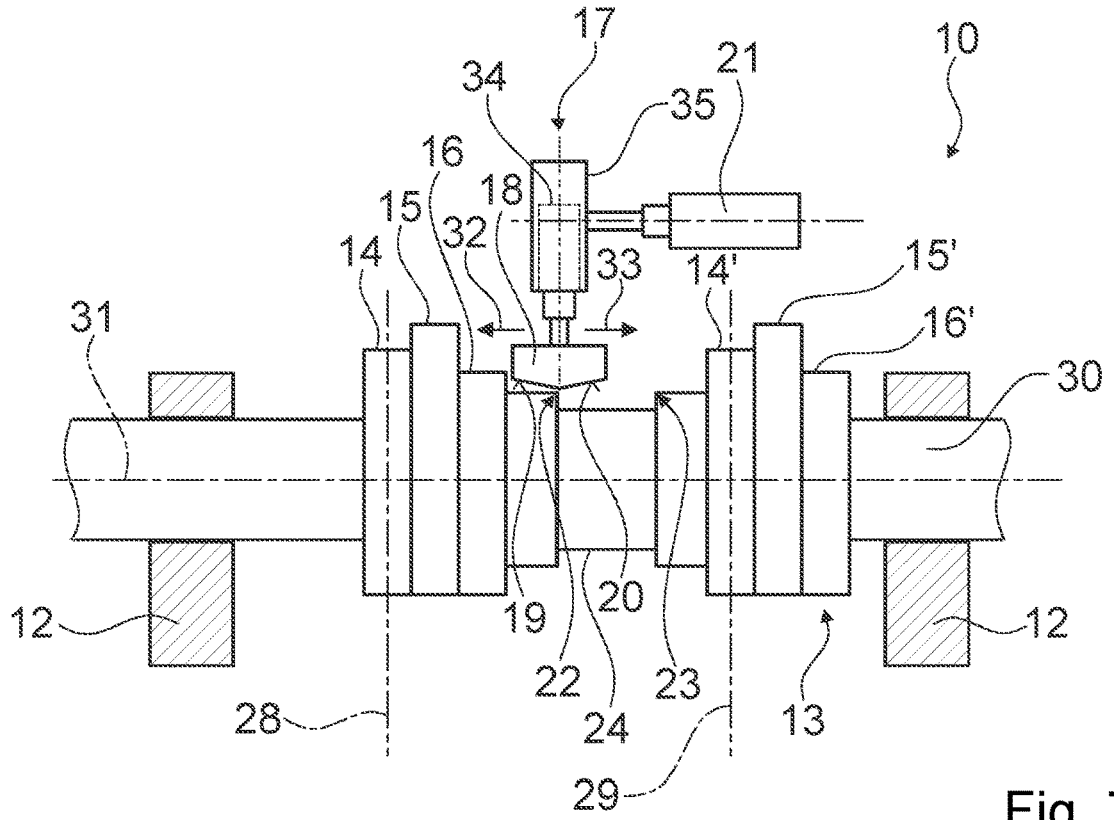
FIG. 7 is a schematic depiction of the valve drive device according to the invention having the cam unit in a further intermediary position from the first switching position into the second switching position.
Figure 8:
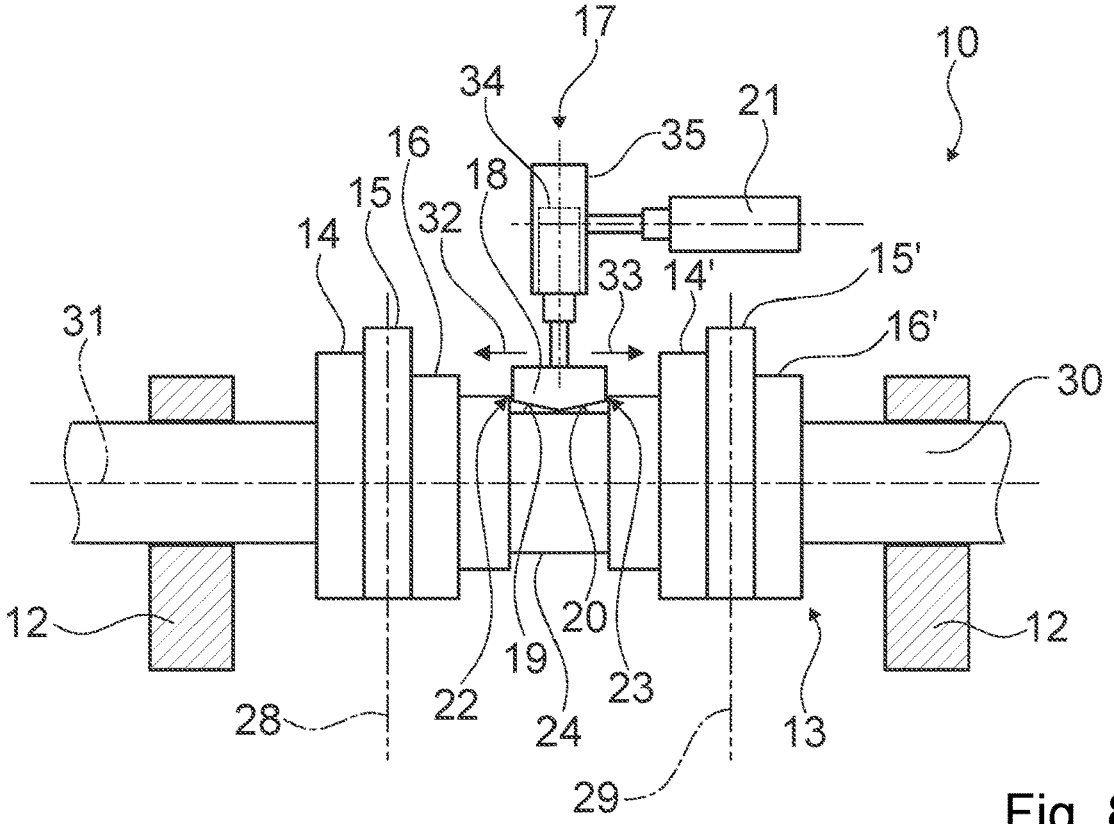
FIG. 8 is a schematic position of the valve drive device according to the invention having the cam unit in the second switching position.
Figure 9:
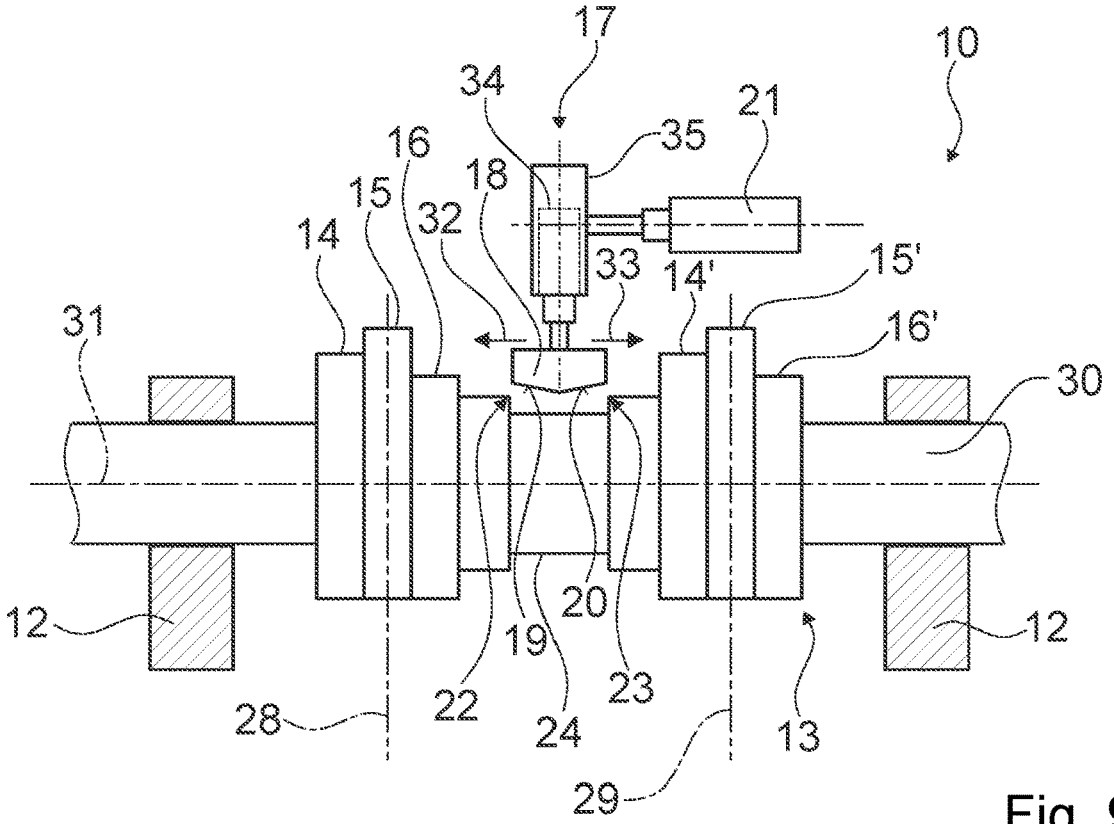
FIG. 9 is a schematic depiction of the valve drive device according to the invention having a cam unit in an intermediary position from the second switching device into the third switching position.

In FIGS. 2 to 11, the valve drive device 10 is respectively shown in different states of a method for the operation of the valve drive device 10. FIG. 2 shows the valve drive device 10 in a second switching position. The displacement body 18 is here in engagement with the groove 24 of the cam unit 13. The valves 28, 29 are supplied with a large stroke. To prepare a switching of the valve drive device 10 from the second switching position into the first switching position, the displacement body 18 is radially moved away from the cam unit 13 by means of the actuator 34 (FIG. 3). Then, to switch the valve drive device 10 from the second switching position into the first switching position, the switching unit 17 is shifted by means of the shifting element 21. The switching unit 17 is shifted into the second switching position (FIG. 4). Following this, the displacement body 18 is moved radially towards the cam unit 13 by means of the actuator 34, such that the cam unit 13 is displaced in the second actuation direction 33 by means of the second contact surface 20. The valve drive device 10 is now in a first switching position (FIG. 5). To prepare a switching of the valve drive device 10 from the first switching position back into the second switching position, the displacement body 18 is radially moved away from the cam unit 13 by means of the actuator 34. Then, to switch the valve drive device 10 from the first switching position into the second switching position, the switching unit 17 is shifted by means of the shifting element 21. The switching unit 17 is shifted into the first switching position (FIG. 7). Following this, the displacement body 19 is radially moved towards the cam unit 13 by means of the actuator 34, such that the cam unit 13 is displaced in the first actuation direction 32 by means of the first contact surface 19. The valve drive device 10 is now back in a second switching position (FIG. 8). To prepare a switching of the valve drive device 10 from the second switching position into the third switching position, the displacement body 18 is radially moved away from the cam unit 13 by means of the actuator 34. Then, to switch the valve drive device 10 from the second switching position into the third switching position, the switching unit 17 is shifted by means of the shifting element 21. The switching unit 17 is shifted into the third switching position (FIG. 10). Following this, the displacement body 19 is radially moved towards the cam unit 13 by means of the actuator 34, such that the cam unit 13 is displaced in the first actuation direction 32 by means of the first contact surface 19. The valve drive device 10 is now in a third switching position (FIG. 11). To prepare a switching of the valve drive device 10 from the third switching position back into the second switching position, the displacement body 19 is radially moved away from the cam unit 13 by means of the actuator 34. Then, to switch the valve drive device 10 from the third switching position back into the second switching position, the switching position 17 is shifted by means of the shifting element 21. The switching unit 17 is shifted into the first switching position. Following this, the displacement body 18 is radially moved towards the cam unit 13 by means of the actuator 34, such that the cam unit 13 is displaced in the second actuation direction 33 by means of the second contact surface 20. The valve drive device 10 is now back in a second switching position (FIGS. 2 and 8).

LIST OF REFERENCE CHARACTERS

10 Valve drive device
11 Internal combustion engine
12 Support element
13 Cam unit
14 Cam tracks
15 Cam tracks
16 Cam tracks
17 Switching unit
18 Displacement body
19 Contact surface
20 Contact surface
21 Shifting element
22 Displacement contour
23 Displacement contour
24 Groove
25 Motor vehicle
26 Drive wheel
27 Multistage gear
28 Valve
29 Valve
30 Cam shaft
31 Axis of rotation
32 Actuation direction
33 Actuation direction
34 Actuator
35 Housing
b1 Width
b2 Width

The invention claimed is:

1. A valve drive device, comprising:

an axially shiftable cam unit allocated to a valve, wherein the cam unit has at least three cam tracks; and a switching unit, wherein the switching unit includes a displacement body, wherein the cam unit is displaceable in a first actuation direction and in a second actuation direction by the displacement body, and wherein the first actuation direction is opposite the second actuation direction;

wherein the displacement body has at least two contact surfaces;

wherein the at least two contact surfaces are angled in relation to each other.

2. The valve drive device according to claim 1, wherein the cam unit is allocated to at least two valves.

3. The valve drive device according to claim 1 further comprising a shifting element, wherein the switching unit is adjustable by the shifting element.

4. The valve drive device according to claim 3, wherein the shifting element has at least three shifting positions.

5. The valve drive device according to claim 1, wherein a width of the displacement body is substantially double a width of a cam track of the at least three cam tracks.

6. The valve drive device according to claim 1, wherein the cam unit has at least two displacement contours formed to correspond to the displacement body.

7. The valve drive device according to claim 6, wherein the at least two displacement contours are formed as respective edges of a groove in the cam unit.

8. A method for operating a valve drive device according to claim 1.

* * * * *